US009347466B2

(12) United States Patent
Hoglund

(10) Patent No.: US 9,347,466 B2
(45) Date of Patent: May 24, 2016

(54) ACTUATOR

(71) Applicant: CARGINE ENGINEERING AB, Angelholm (SE)

(72) Inventor: Anders Hoglund, Munka Ljungby (SE)

(73) Assignee: FREEVALVE AB, Angelholm (SE)

( * ) Notice: Subject to any disclaimer, the term of this patent is extended or adjusted under 35 U.S.C. 154(b) by 103 days.

(21) Appl. No.: 14/353,052

(22) PCT Filed: Oct. 19, 2012

(86) PCT No.: PCT/SE2012/051121
§ 371 (c)(1),
(2) Date: Apr. 21, 2014

(87) PCT Pub. No.: WO2013/058704
PCT Pub. Date: Apr. 25, 2013

(65) Prior Publication Data

US 2014/0238009 A1 Aug. 28, 2014

(30) Foreign Application Priority Data

Oct. 21, 2011 (SE) ..... 1150976

(51) Int. Cl.
*F01L 9/02* (2006.01)
*F15B 15/14* (2006.01)
(Continued)

(52) U.S. Cl.
CPC ..... *F15B 15/149* (2013.01); *F01L 9/02* (2013.01); *F15B 21/12* (2013.01); *F01L 9/04* (2013.01)

(58) Field of Classification Search
CPC ..... F15B 15/149; F15B 21/12; F01L 9/02; F01L 9/04
USPC ..... 123/90.12, 90.13
See application file for complete search history.

(56) References Cited

U.S. PATENT DOCUMENTS 4,724,801 A 2/1988 O'Neill
5,193,495 A 3/1993 Wood, III
(Continued)

FOREIGN PATENT DOCUMENTS

DE 19501495 11/1995
DK 154165 7/1984
(Continued)

OTHER PUBLICATIONS

Extended European search report, dated Aug. 26, 2015; Application No. 12841388.7.
(Continued)

*Primary Examiner* — Ching Chang
(74) *Attorney, Agent, or Firm* — Young & Thompson

(57) ABSTRACT

An actuator, including a cylinder, an actuator piston displacably arranged in the cylinder, a pressure fluid circuit having a channel mouthing in the cylinder, an indirectly electrically controlled first valve body, arranged in the channel for controlling a flow of a pressure fluid in the channel, and a second valve body, arranged in or at the channel to open and close the channel, the second valve body being a member fixedly connected to the actuator piston, and the first valve body and the second valve body being arranged in series with each other in the channel. The actuator further includes an electrically controlled three-way valve that is arranged to alternately open for a pressure fluid flow from a high pressure source and a pressure fluid flow from a low pressure source, chosen pressure fluid flow being arranged to act against and admit displacement of the first valve body.

20 Claims, 5 Drawing Sheets

(51) Int. Cl.
*F15B 21/12* (2006.01)
*F01L 9/04* (2006.01)

(56) References Cited

U.S. PATENT DOCUMENTS

| | | | |
|---|---|---|---|
| 5,595,148 | A | 1/1997 | Letsche et al. |
| 7,225,771 | B2 | 6/2007 | Hedman |
| 7,472,669 | B2 | 1/2009 | Hedman |
| 2005/0263117 | A1 | 12/2005 | Hedman |
| 2006/0086328 | A1 | 4/2006 | Hedman |
| 2007/0175423 | A1 | 8/2007 | Hedman |

FOREIGN PATENT DOCUMENTS

| | | |
|---|---|---|
| EP | 1918533 | 5/2008 |
| JP | 59170414 | 9/1984 |
| WO | 0204790 | 1/2002 |
| WO | 03-102385 | 12/2003 |
| WO | 2005-083239 | 9/2005 |
| WO | 2007081274 | 7/2007 |
| WO | 2012166035 | 12/2012 |

OTHER PUBLICATIONS

International Search Report dated Feb. 19, 2013, corresponding to PCT/SE2012/051121.

ACTUATOR

TECHNICAL FIELD OF THE INVENTION

The present invention relates to an actuator comprising a cylinder, an actuator piston arranged axially displacable in said cylinder, a pressure fluid circuit having a channel mouthing in said cylinder, an indirectly electrically controlled first valve body that is arranged in said channel for controlling a flow of a pressure fluid in said channel and a second valve body that is arranged in or at said channel to open and close the channel.

The actuator is useable for generating pressure pulses and movements of different purposes. However, one especially preferred field of application comprises combustion engines, in which an actuator according to the present invention is suggested to be used for driving one or more inlet or outlet valves to the combustion chamber of the engine. Thus, the invention comprises also combustion engines provided with actuators according to the invention for driving the engine valves, which replace conventional cam shaft driven valves and thereby eliminates the need of one or more cam shafts. Alternatively the actuator can be used to drive a piston that arranged in a cylinder connected to a combustion chamber of a combustion engine to attain variable compression.

Preferably the pressure fluid used in the actuator for driving the actuator piston thereof is a gas or gas mixture, preferably air, that is pressurized to any suitable level.

It shall already at this stage be pointed out that hereinafter in this text when using the terms that a valve of valve body is opened and closed, respectively, it is meant that it open and close for pressure fluid flow in a channel past the location of the valve or valve body. The terms closed position and opened position shall be understood in a corresponding way.

BACKGROUND OF THE INVENTION AND PRIOR ART

Through document WO0204790 pressure pulse generators are known, in which at least two valve bodies are arranged in series in a channel and by being sequentially opened and closed short pressure pulses of pressure fluid are attained which are guided into an actuator cylinder in which a displacable actuator piston is arranged. The actuator piston is in its turn connected to an inlet or outlet valve to a combustion engine. The two adjacent valve bodies are driven by means of one electro magnet each, the activation of which is controlled by a drive unit connected to the combustion engine, which drive unit is provided with software suitable for the application.

A pressure fluid pulse is attained by having the one of the two valve bodies that in the channel in which the valve bodies are located that is located closest to a high pressure source to open while the other valve body is kept in its closed position, whereupon the first valve body is closed and the second valve body is opened. Thereby a pulse of pressure fluid, corresponding to the amount of pressure fluid having high pressure that has been located in the channel between said valve bodies, will be dispatched in the channel in the direction of the actuator piston that is brought into movement. An overlap of the time during which both valve bodies are open for pressure fluid flow can also be used in order to increase the size of the generated pressure pulse.

However, such a construction has the disadvantage that the size of the pulse is decided beforehand in the drive unit and not directly correlates to the wanted displacement of the actuator piston. In order to guarantee that the pulse is not too small, the pulse must be dimensioned such that it is secured that it is big enough for a specific displacement of the actuator piston. Thereby unnecessarily much energy is used for a given displacement of the piston, since a safety marginal is needed.

U.S. Pat. No. 5,193,495 disclose a valve control device comprising an actuator piston that is displacably arranged in a chamber. Furthermore, the disclosed valve control device comprises a first valve that is arranged in a first channel of a pressure fluid circuit, which first channel mouth in said chamber and the first valve is arranged to control the flow of a pressure fluid in this first channel. Thereto, the disclosed valve control device comprises a second valve body that is arranged in a second channel of the pressure fluid circuit, which second channel mouth in said chamber and the second valve is arranged to open and close this second channel. Thus, the first valve and the second valve are not arranged in series in one and the same channel of the pressure fluid circuit.

DK 154165 discloses an actuator comprising an actuator casing having a cylinder and an actuator piston (lower part of the axially displacable "stempel") displacably arranged in said cylinder. Furthermore, the actuator comprises a pressure fluid circuit having a channel mouthing in said cylinder, an directly electrically controlled first valve body arranged outside the actual actuator casing but still in said channel, and a second valve body (upper part of the axially displacable "stempel") arranged in the channel. Thereto, the second valve body is fixedly connected to the actuator piston and arranged in series with the first valve body in said channel. The assembled body that constitute the actuator piston and the second valve body has in this context very large mass and is thus inert to accelerate and brake, which bring about restrictions for the useable field of applications of the actuator. Furthermore, the first valve body is directly electrically controlled, and the mass of the first valve body directly affects the opening and closing speed thereof, which is extended by increasing mass.

Object of the Invention

The present invention aims at obviating the aforementioned disadvantages and failings of previously known pressure pulse generators and actuators, and at providing an improved actuator.

It is also an object of the present invention to provide an actuator that comprises few electrical control devices, and preferably just one electrical control device.

SUMMARY OF THE INVENTION

The object of the invention is solved by means if the initially defined actuator, having the features defined in the independent claim. Preferred embodiments of the present invention are further defined in the dependent claims.

According to a first aspect of the present invention it is provided an actuator of the initially defined type, that is characterized in that the actuator further comprises an electrically controlled three-way valve that is arranged to alternately open for a pressure fluid flow from a high pressure source (HP) and a pressure fluid flow from a low pressure source (LP), chosen pressure fluid flow being arranged to act against and admit displacement of the first valve body. At least from a starting position a pulse that is attained by opening the first valve body, while the second valve body is in an open position, will result in a displacement of the actuator piston and thereby a displacement of the second valve body such that the latter cut off the fluid communication in the channel and thereby closes the channel, the pulse that drive the actuator piston being terminated. Thereby a direct correlation between the pulse length and the movement of the actuator piston is attained. By having the first valve body being indirectly electrically controlled and alternately using pressure fluid flow from a high pressure source and from a low pressure source in order to admit displacement of the first valve body, more rapid opening and closing speeds for the first valve are obtained then if the opening and closing of the first valve body would be directly electrically controlled.

Preferably said element that form the second valve body is constituted by a rod projecting in the axial direction from the piston and into said channel.

It is preferred that the rod projects into the channel in a cylinder head arranged at one end of the cylinder.

Preferably, the second valve body is arranged to open for fluid flow in the channel in a first end position of the actuator piston. When the first valve body is opened in said end position pressure fluid will act against the actuator piston that is displaced in the direction towards a second end position. The second valve body is thereby arranged to, due to the displacement of the actuator piston, be displaced to a position in which it closes for further flow from the high pressure source in direction towards the actuator piston.

According to the invention the second valve body is arranged to close for fluid flow in the channel in a position between the first end position and the second end position of the actuator piston. In order to obtain a return of the actuator piston to the first position the actuator comprises an evacuation channel mouthing in said cylinder and that preferably is opened/closed by said first valve or houses another valve, suitably a directly or indirectly electrically controlled/driven valve. When the evacuation channel is opened, while the actuator piston is in its second end position, pressure fluid is evacuated and the actuator piston returns to its first end position. In order to make possible such a return the piston is preferably biased, preferably by means of a spring means, in the direction towards the first end position. The spring means may be a mechanical spring of a gas spring. In the case when the actuator piston is connected to and drive an inlet or an outlet valve of a combustion engine the spring may be constituted by a spring lifting this valve to its closed position.

It is furthermore preferred that the rod of the actuator piston comprises a narrow part, which narrow part in said first end position is located right in front of the channel and opens for pressure fluid though this. The channel has preferably a first branch, which is straight, and in which the rod is arranged to be displaced, and thereto a second branch running transversally to the first branch, the first valve body being arranged in said second branch. The rod has a part having a cross section corresponding to the cross section of the first branch, which part closes the channel as long as it is located right in front of the second branch or in the first branch between the second branch and the mouthing in the cylinder, herein defined as downstream the second branch. The narrow part of the rod is preferably located closer to the actuator piston than the thickened part. In the first end position of the actuator piston it has been displaced to a location in which the thickened part is no longer closing the fluid flow through the first branch and the second branch into the cylinder.

According to a preferred embodiment of the invention the actuator constitute a part of a valve actuator, which comprises a valve of a combustion chamber of a combustion engine, wherein the actuator piston is operatively connected to and drive said valve.

According to a preferred embodiment of the invention said channel lead to a high pressure source for said pressure fluid and the first position of the actuator piston is a position in which the piston is retracted and will be displaced towards the second end position when the channel is opened such that pressure fluid is admitted to communicate with and act against the actuator piston in said cylinder.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS

Figure 1:
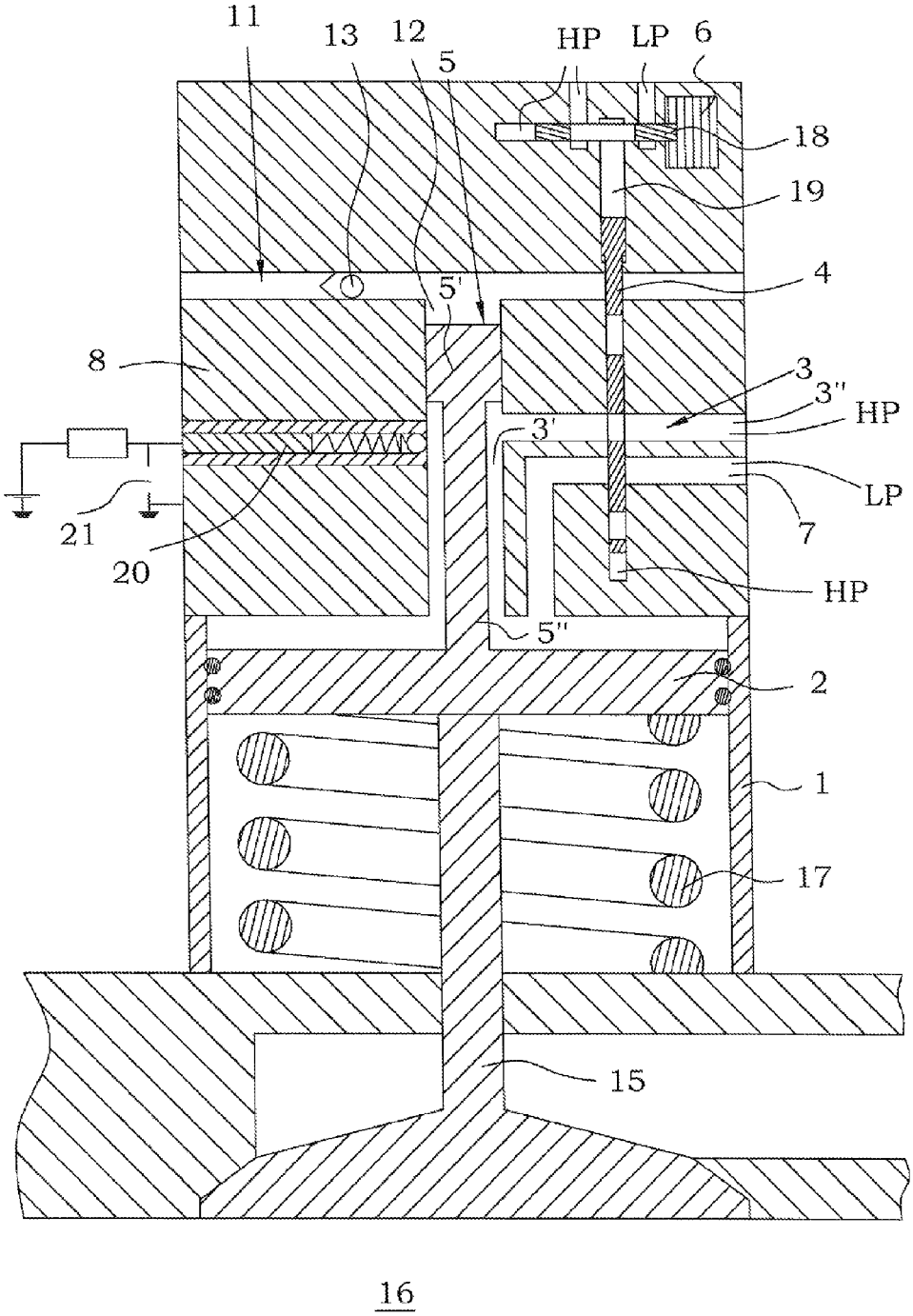
FIG. 1 is a schematic cross section side view of an actuator according to a first embodiment, the actuator piston being located in a first, upper position.
Figure 2:
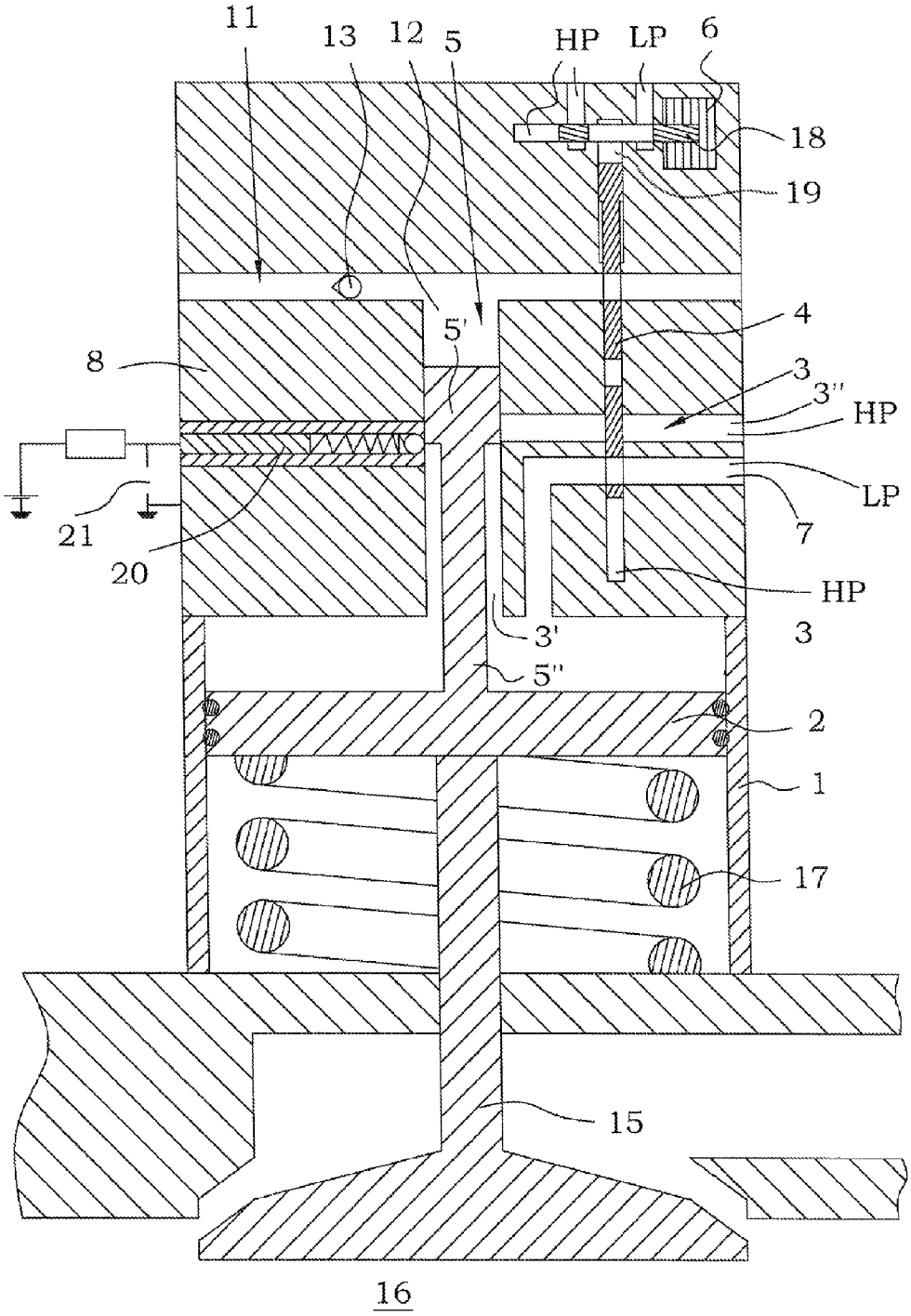
FIG. 2 is a schematic cross section side view of the actuator shown in FIG. 1 disclosing the actuator piston in a second position.

FIGS. 1 and 2 disclose a first, preferred embodiment of the present invention. Thus, FIGS. 1 and 2 disclose an actuator. The actuator constitute, in the disclosed preferred embodiment, part of a valve actuator for an internal combustion engine.

The actuator comprises a cylinder 1, an actuator piston 2 that in the axial direction is displacable in the cylinder 1, a pressure fluid circuit having a channel 3 mouthing in said cylinder 1, an indirectly controlled first valve body 4, which first valve body 4 is arranged in said channel 3 for controlling a flow of a pressure fluid in the channel 3, and a second valve body 5, that is arranged in or at the channel 3 to open and close the channel 3. The pressure fluid is preferably constituted by a pressurized gas or gas mixture, preferably air. The second valve body 5 is constituted by a rod that is connected to and project in the axial direction from the one end of the actuator piston 2 and into the channel 3. The first valve body 4 and the second valve body 5 are arranged in series in said channel 3, and the mutual order of the first valve body 4 and the second valve body 5 is of less importance, however, from a manufacturing point of view it is preferred that the second valve body 5 is located between the cylinder 1 and the first valve body 4. The indirectly controlled first valve body 4 may also be called first slave valve. By electrically controlled is meant controlled by means of an electromagnetic device, by means of a piezoelectric device, etc.

The channel 3 may be described as being divided into a first branch 3', which extend in the direction of the actuator piston and in which the rod 5 is displacably arranged, and a second branch 3" that extend transversally said first branch 3' and that mouth from the side in the first branch 3'. The rod 5 has a first, thickened part 5', which is located distantly from the actuator piston 2 and a narrow part 5" that is located closer the actuator piston 2 than the thickened part that is connected to the thickened part 5' and the actuator piston 2. The first, thickened part 5' has a cross section that correspond to the cross section of the first branch 3' of the channel 3, and that accordingly seal against passage of pressure fluid where it is located in the channel 3. The narrow part extend a distance equal to or longer than the distance between the crossing between the branches 3', 3" of the channel 3 and the mouth of the channel 3 in the cylinder 1. When the narrow part 5" of the rod 5 is located at the mouth of the second branch 3" in the first branch 3', it allows pressure fluid to pass through the channel 3 into the cylinder 1. This position corresponds to the first, upper end position of the actuator piston 2.

Furthermore, the inventive actuator comprises a three-way valve. In the embodiment disclosed in FIGS. 1 and 2 said three-way valve is constituted by a so-called pilot valve 18 that is arranged to be driven by an electromagnet 6. The three-way valve may also be constituted by a piezoelectric valve, or the like electrically controlled valve. The three-way valve/pilot valve 18 is arranged to alternately open for pressure fluid flow from a high pressure source (HP) and for pressure fluid flow from a low pressure source (LP), chosen pressure fluid flow being arranged to act against and admit displacement of the first valve body 4. The chosen pressure fluid flow is allowed to flow into a activation channel 19, the upper end of the first valve body 4 being arranged in the activation channel 19 whereupon said pressure fluid flow can act against and displace the first valve body 4. The pilot valve 18 is preferably biased in a first direction (right) by means of a gas spring, mechanical spring or the like, whereupon an activation of the electromagnet 6 will displace the pilot valve 18 in a second direction (left) and when the electromagnet 6 is shut off the pilot valve 18 returns by being displaced in the first direction (right). According to the invention the first valve body 4 is thus indirect electrically controlled, since the displacement of the first valve body 4 is controlled by pressure fluid that is controlled by the position of the three-way valve, which in its turn is direct electrically controlled.

When the pilot valve 18 open for pressure fluid flow from a high pressure source HP to the activation channel 19 the first valve body 4 is displaced to a lower position, disclosed in FIG. 1. The first valve body 4 is thus brought to open for pressure fluid flow in the channel 3 from a high pressure source HP connected to the channel 3. A pulse of pressure fluid will then act against and displace the actuator piston 2 in the cylinder from the position disclosed in FIG. 1 to and past the position disclosed in FIG. 2, and a further distance to a not disclosed lower end position, the additional distance takes place due to the kinetic energy of the actuator piston 2 and the always present over pressure in the cylinder 1. Thus, FIG. 1 discloses a momentary picture when the pilot valve 18 is displaced to the right and the first valve body 4 is displaced downwards but the actuator piston 2 has not yet started to move. Both positions disclosed in FIG. 1 and FIG. 2 corresponds to the upper end position of the actuator piston 2, and a position when the rod 5 precisely has cut off the pressure fluid flow in the channel 3, respectively. The actuator piston 2 real lower end position is not disclosed in the figures. On its journey towards the second end position (FIG. 2) the thickened part 5' of the rod 5 will be located just in front of the mouth of the second branch 3" in the first branch 3' and thereby close the channel 3 for further pressure fluid flow.

The actuator piston 2 is biased in the direction towards the first, upper position by means of a spring 17. In the preferred embodiment the actuator piston is operatively connected to and drives an inlet or an outlet valve 15 of a combustion chamber of a combustion engine. The actuator piston 2 is in the disclosed embodiment connected to the inlet or the outlet valves 15 by abutting an upper end of its valve shaft. The bias is then preferably realized by means of a spring that bias said inlet or outlet valve to its closed position. Alternative solutions regarding how the bias shall be realized are feasible and within the scope of the present invention.

In order to make a return movement of the actuator piston 2 possible, the actuator comprises an evacuation channel 7 leading to a low pressure source (LP). The channel 3 leading to the high pressure source HP as well as the evacuation channel 7 is arranged in the cylinder head 8 of the cylinder 1. In the embodiment disclosed in FIGS. 1 and 2 the first valve body 4 is also arranged in said evacuation channel 7 in order to control a flow of a pressure fluid in the evacuation channel 7. The movement of the first valve body 4 also control when the evacuation channel 7 shall be opened and the evacuation of the pressure fluid from the cylinder 1 shall take place. In FIG. 2 the pilot valve 18 is disclosed displaced to the left in order to open for communication between a low pressure source (LP) and the activation channel 19, and thereby the first valve body 4 that is biased in the direction upwards by means of a gas spring, a mechanical spring, or the like, is displaced to the upper position. While the first valve body 4 has been displaced the channel 3 has been closed and thereby the evacuation channel 7 has been opened in order to admit evacuation of pressure fluid from the cylinder 1. Alternatively there may be a small overlap between the closure of the channel 3 and the opening of the evacuation channel 7, in order to shorten the stroke of the first valve body 4. When the evacuation takes place, the actuator piston 2 returns, due to it being biased, from its lower end position, via the position disclosed in FIG. 2 to the first, upper end position disclosed in FIG. 1. In the case when a gas spring is located under the first valve body 4, the area of the upper end of the first valve body 4, which upper end is located in the activation channel 19, shall be greater than the lower end in order to admit biasing in the direction upwards. Preferably the area of the upper end shall be fifty percent greater than the lower area. The evacuation can be further improved/accelerated by having another channel (not shown), that is connected to a low pressure source, be connected to the channel 3 at a position located between the first branch 3' and the first valve body 4. This not shown channel shall be opened at the same time as the evacuation channel 7 by means of the first valve body 4.

The actuator comprises furthermore a hydraulic lock 11, consisting of an extension of the first branch 3' of the channel 3. This extension constitute a channel 12 in which a non-return valve 13 is arranged. The channel 12 constitutes a part of a hydraulic circuit. The non-return valve 13 is arranged to admit liquid to pass in the direction towards that part of the channel that constitute an extension of the channel in which the rod 5 projects, and prevents flow in the opposite direction. Thereto a hydraulic valve is located in the channel 12, which hydraulic valve is arranged to open for evacuation of liquid from said extension of the branch 3' in connection with evacuation of pressure fluid from the cylinder 1 when the actuator piston 2 shall make a return movement to the upper end position. The hydraulic valve is in the disclosed embodiment connected to the first valve body 4 and follows its movements, in such a way that it closes the hydraulic channel 12 when the first valve body 4 closes the evacuation channel 7, and opens the hydraulic channel 12 when the first valve body 4 opens the evacuation channel 7. In such a way, thanks to the hydraulic lock, the actuator piston 2 is prevented from unwontedly swinging back from the second, lower position, to the point of time of a cycle when the evacuation channel 7 is opened for evacuation and return of the actuator piston 2. It shall be pointed out that the hydraulic valve opens just before evacuation takes place via the evacuation channel 7. Thus, one and the same first valve body 4 can be used in order to control supply and evacuation of pressure fluid as well as evacuation of hydraulic liquid.

According to a preferred embodiment the actuator is controlled, by being controlled from a control unit provided with software suitable for the application, to deliver pressure pulses that are used to recurrently open and close an inlet or outlet valve 15 of a combustion chamber 16 of a combustion engine. The actuator piston 2 of the actuator is thereto, as disclosed earlier, preferably operatively connected to said inlet or outlet valve and transfer directly its movement to this. A shooting pulse, that shoots the actuator piston 2 from the first, upper end position shown in FIG. 1 is obtained by activation and thereby opening of the channel 3 by means of the first valve body 4 while the evacuation channel 7 is kept closed by means of the first valve body 4. The pressure fluid in the channel 3 will then generate a pressure in the cylinder 1 that displaces the piston 2 towards said second position. When the thickened part 5' of the second valve body/rod 5 has been displaced as long as it covers the second branch 3" of the channel 3, the channel 3 is closed and thereby cuts off the pulse. The piston 2 carries on moving due to its kinetic energy as well as the constant over pressure in the cylinder, and reaches the second end position when the spring has absorbed the energy. Now the engine valve driven by the actuator is open, and the software in the drive unit determine how long it shall stay open with regard to other operational parameters of the engine forming input to the drive unit. In the meantime, from the time when the second valve body/rod 5 closes for flow in the channel 3, the first valve body 4 is controlled to once again close the channel 3. When the engine valve is about to be closed the electromagnet 6 is controlled, whereupon the three-way valve open the pressure fluid flow from a low pressure source (LP) acting against and admitting displacement of the first valve body 4 upwards, and the first valve body 4 closes the first channel 3 and then opens the evacuation channel 7, while the actuator piston 2 biased by means of a spring 17 returns to the position shown in FIG. 1.

In FIGS. 1 and 2 also a position sensor 20 is shown, that preferably is of contact type. A spring-loaded ball of electrically conducting material is mounted in an electrically isolated casing in the cylinder head 8. The ball projects into the first branch 3' of the channel 3. In the starting position the ball is not grounded. When the actuator is activated and the thickened part 5' of the rod 5 passes the ball electrical contact with ground arise. Since the ball is connected to a power source via a resistance one can output a signal at a signal output terminal 21 indicating that the rod 5 and thus the actuator piston 2 has passed a specific position. This signal can be used as an on/off-sensor indicating the position of the actuator piston 2. The rod 5 may also be provided with additional grooves providing electric contact or interruptions at additional displacement of the rod 5. Thereby, multiple positions of the actuator piston 2 can be identified. This can also be used in order to calibrate the valve lift and for other purposes depending on the application.

Figure 3:
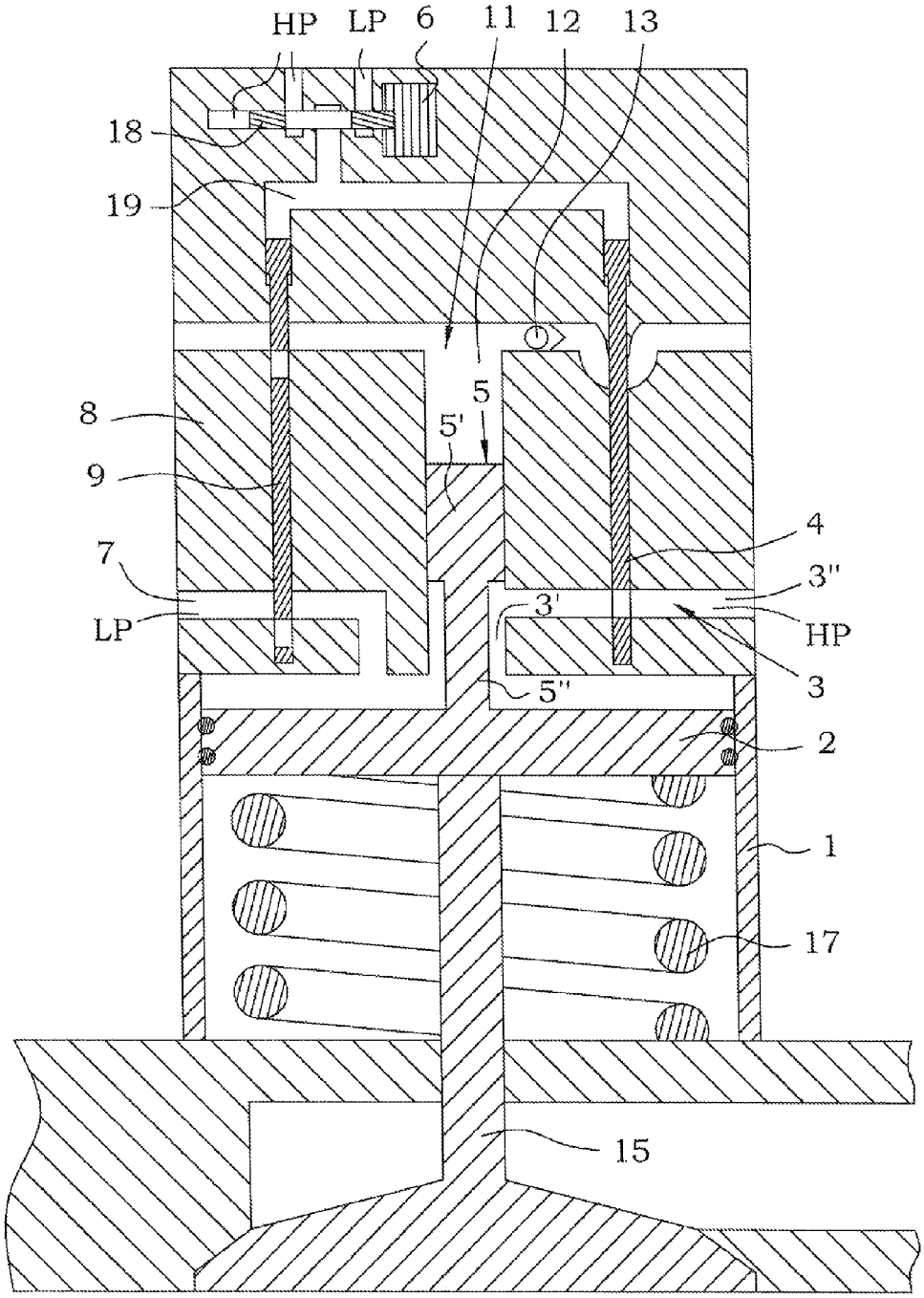
FIG. 3 is a schematic cross section side view, corresponding to FIG. 1, of an actuator piston according to another embodiment.
Figure 4:
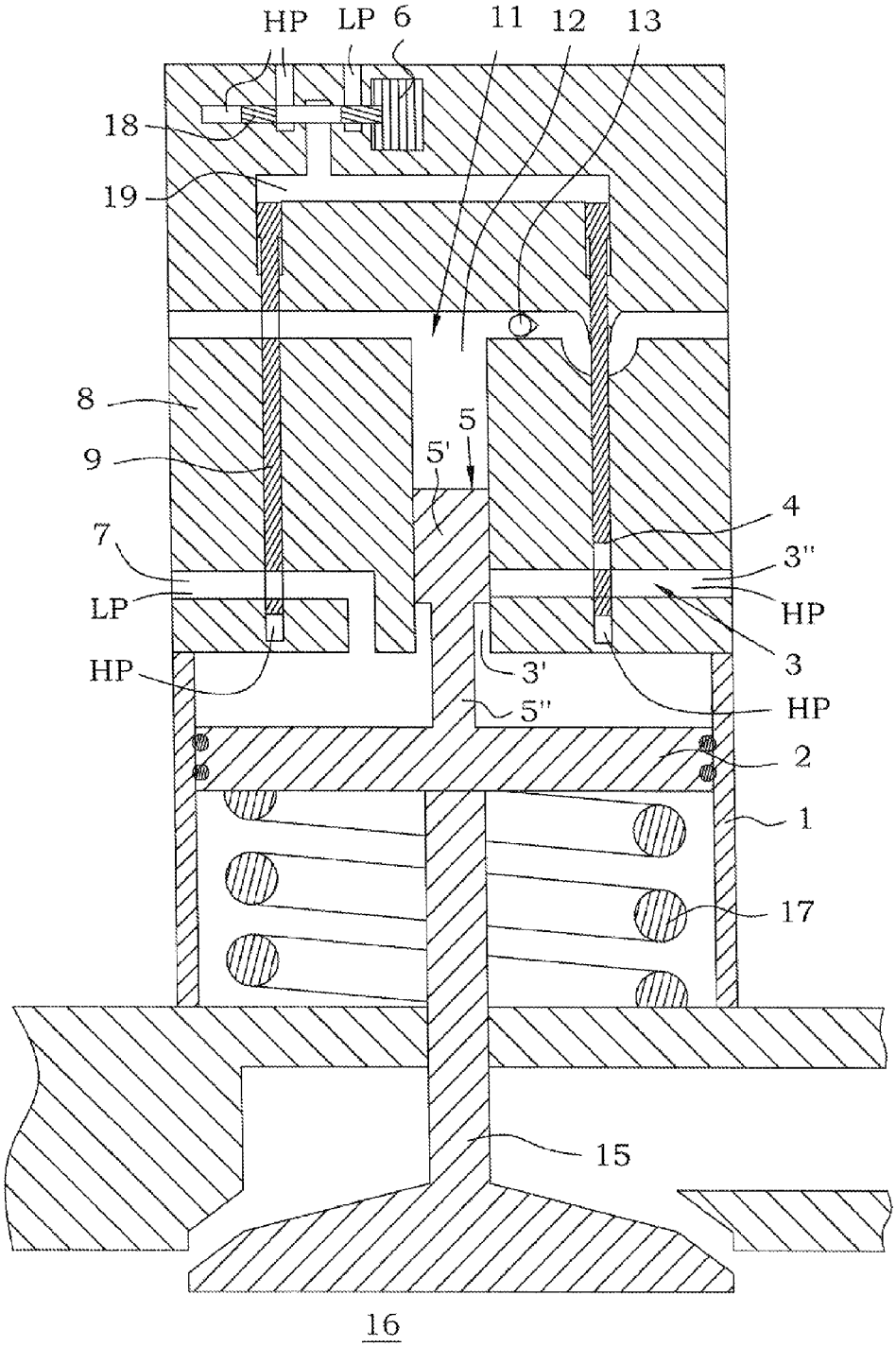
FIG. 4 is a schematic cross section side view, corresponding to FIG. 2, of the actuator piston disclosed in FIG. 3.

FIGS. 3 and 4 discloses a second embodiment of the present invention. Like parts have the same reference numbers and only the parts that are distinguish from the first embodiment will be described.

Unlike the first embodiment disclosed in FIGS. 1 and 2 the second embodiment according to FIGS. 3 and 4 also a third valve body 9 that instead of the first valve body 4 is arranged in said evacuation channel 7 for controlling a flow of a pressure fluid in the evacuation channel 7. By controlling the second valve body 9 it is decided when the evacuation channel 7 shall open and evacuation of pressure fluid from the cylinder 1 shall take place. The upper end of the second valve body 9 is arranged in the activation channel 19 whereupon said pressure fluid flow that is determined by the three-way valve can act against and displace the second valve body 9 in a corresponding way as the first valve body 4. When the second valve body 9 and the first valve body 4 both ends in the same activation channel 19 the displacement of the second valve body 9 and the first valve body 4 will take place in parallel/synchronized. The hydraulic valve is in this disclosed second embodiment connected to the second valve body 9 and thus follows the movements thereof, in such a way that it closes the hydraulic channel 12 when the second valve body 9 closes the evacuation channel 7, and opens the hydraulic channel 12 when the second valve body 9 opens the evacuation channel 7.

The pilot valve 18 and the electromagnet 6 constitute one example of a three-way valve that can be realized in numerous ways using pressure relieved or none pressure relieved techniques. In the present design it is not pressure relieved and the high pressure is used to return the pilot valve 18, such as a gas spring. Without pressure relieve the closing speed will increase according to the pressure which counteract the effect of the drive pressure on the duration of the valve time when the actuator is used as a valve actuator. The duration of the valve actuator will thereby become less sensitive to variations in the drive pressure.

Figure 5:
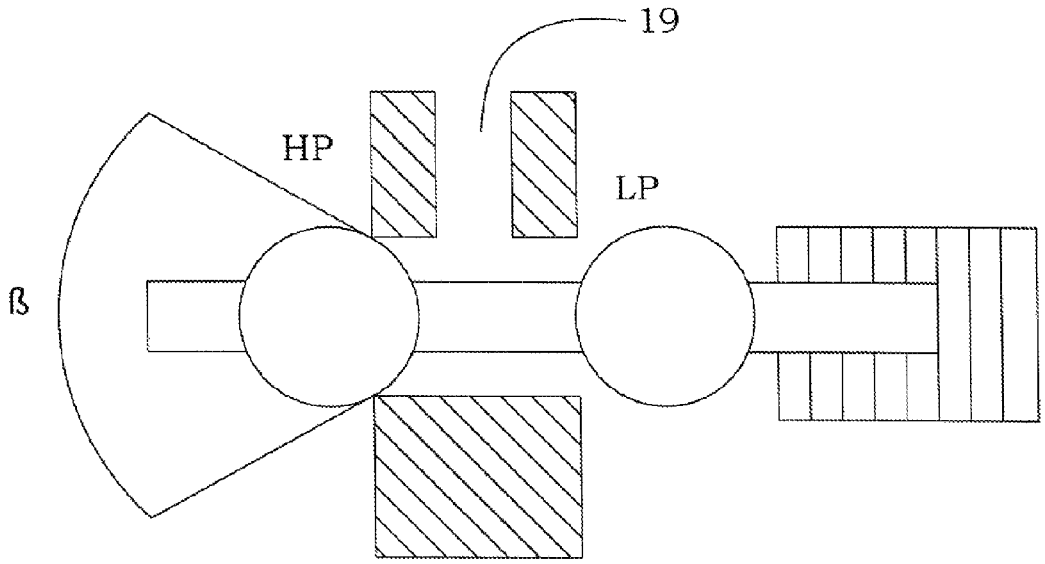
FIG. 5 is a schematic illustration of an embodiment of the three-way valve.

The pilot valve 18 has in the preferred embodiment disclosed in FIG. 5 two valve cones that are spherical or conical, in order to obtain enhanced centering and seal. Thereto, spherical are insensitive to angular displacements. In order to decrease the force needed to open the pilot valve it is preferred that the cone angle β, alternatively the abutment angle of the sphere in the seat is formed such that sealing takes place as close to the centre of the hole as possible. It is preferred that the cone angle, alternatively the abutment angle of the sphere in the seat is formed such that the opening area is maximized under the sub condition that god enough self centering is obtained at the same time. Preferably the cone angle β of the valve cone is in the range 80-130 degrees, preferably 106 degrees. Preferably both the valve cone and the seat are of metal and the valve cone shall be harder than the valve seat. The seat is preferably of such a soft material and formed such that it will initially be formed and adapted to the valve cone such that god sealing is obtained. Another advantage of a so-called seat valve, in contrast to a slide valve that is disclosed in the other figures, is that closeness can be obtained in the end positions and a relatively large area can be obtained for a given hole diameter and stroke. In order to decrease leakage further as well as damping rebound it is possible to cote the valve seat with an elastomer, e.g. vulcanized rubber.

In the none active position the high pressure close the pilot valve 18 such that the drive pressure becomes low. Upon activation the high pressure conduit is opened and the low pressure conduit is closed such that the drive pressure becomes high. Thus, the return spring is not necessary. However, having an extra return spring the return can be faster which can be preferred at low drive pressure.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. An actuator, comprising:

a cylinder (1);

an actuator piston (2) displacably arranged in the cylinder (1);

a pressure fluid circuit having a channel (3) mouthing in said cylinder (1), the pressure fluid being a gas;

an indirectly electrically controlled first valve body (4), arranged in said channel (3) for controlling a flow of a pressure fluid in said channel (3), wherein, in a first position the first valve body (4) keeps the channel (3) of the pressure fluid circuit closed, and in a second position the first valve body (4) keeps the channel (3) of the pressure fluid circuit channel open;

a second valve body (5), arranged in or at said channel (3) to open and close the channel (3), the second valve body (5) being a member fixedly connected to the actuator piston (2), and the first valve body (4) and the second valve body (5) being arranged in series with each other in said channel (3);

an electrically controlled three-way valve (18) that is arranged to alternately open for pressure fluid communication i) between an activation channel (19) and a high pressure source (HP), and ii) between the activation channel (19) and a low pressure source (LP), wherein chosen pressure fluid pressure in the activation channel (19) is arranged to act against and admit displacement of the first valve body (4);

a hydraulic lock (11) comprising a non-return valve (13) located within a further channel (12) extending from said channel (3), wherein the hydraulic lock (11) acts against the second valve body (5) via the further channel (12); and a hydraulic valve located in the further channel (12) and connected to the first valve body (4), wherein the hydraulic valve is open when the first valve body (4) is in the first position keeping the channel (3) of the pressure fluid circuit closed, and the hydraulic valve is closed when the first valve body (4) is in the second position keeping the channel (3) of the pressure fluid circuit open.

2. The actuator according to claim 1, wherein the second valve body (5) is a rod projecting from one end of the piston (2) in into said channel (3).

3. The actuator according to claim 2, further comprising:

a cylinder head (8) located on one end of the cylinder (1), wherein the second valve body (5) projects into the channel (3) in the cylinder head (8) arranged at the one end of the cylinder (1).

4. The actuator according to claim 3, wherein the second valve body is arranged to open for a pressure fluid flow in the channel in a first end position of the actuator piston.

5. The actuator according to claim 3, wherein the second valve body is arranged to close for a fluid flow in the channel in a position between the first end position and a second end position of the actuator piston.

6. The actuator according to claim 3, wherein the actuator forms a part of a valve actuator, which comprises a valve to a combustion chamber of a combustion engine, and in that the actuator piston is operatively connected to and drive said valve.

7. The actuator according to claim 2, wherein said rod comprises a narrow part, which narrow part is located right in front of the channel (3) and open for pressure fluid flow through said channel (3) in a first end position of the actuator piston (2).

8. The actuator according to claim 7, wherein the actuator forms a part of a valve actuator, which comprises a valve to a combustion chamber of a combustion engine, and in that the actuator piston is operatively connected to and drive said valve.

9. The actuator according to claim 2, wherein the second valve body is arranged to open for a pressure fluid flow in the channel in a first end position of the actuator piston.

10. The actuator according to claim 2, wherein the second valve body (5) is arranged to close for a fluid flow in the channel (3) in a position between the first end position and a second end position of the actuator piston (2).

11. The actuator according to claim 2, wherein the actuator forms a part of a valve actuator, which comprises a valve to a combustion chamber of a combustion engine, and in that the actuator piston is operatively connected to and drive said valve.

12. The actuator according to claim 2, wherein said channel (3) leads to the high pressure source (HP) for said pressure fluid and in that a first position of the actuator piston (2) is a position in which the piston (2) is retracted and will be displaced to a second end position while the channel (3) will be opened and the pressure fluid is admitted to communicate with and act against the actuator piston (2) in said cylinder (1).

13. The actuator according to claim 1, wherein the second valve body (5) is arranged to open for a pressure fluid flow in the channel (3) in a first end position of the actuator piston (2).

14. The actuator according to claim 13, wherein the second valve body is arranged to close for a fluid flow in the channel in a position between the first end position and a second end position of the actuator piston.

15. The actuator according to claim 13, wherein the actuator forms a part of a valve actuator, which comprises a valve to a combustion chamber of a combustion engine, and in that the actuator piston is operatively connected to and drive said valve.

16. The actuator according to claim 1, wherein the second valve body (5) is arranged to close for a fluid flow in the channel (3) in a position between the first end position and a second end position of the actuator piston (2).

17. The actuator according to claim 16, wherein the actuator forms a part of a valve actuator, which comprises a valve to a combustion chamber of a combustion engine, and in that the actuator piston is operatively connected to and drive said valve.

18. The actuator according to claim 1, wherein the actuator forms a part of a valve actuator, which comprises a valve (15) to a combustion chamber (16) of a combustion engine, and in that the actuator piston (2) is operatively connected to and drive said valve (15).

19. The actuator according to claim 1, wherein said channel (3) leads to the high pressure source (HP) for said pressure fluid and in that a first position of the actuator piston (2) is a position in which the piston (2) is retracted and will be displaced to a second end position while the channel (3) will be opened and the pressure fluid is admitted to communicate with and act against the actuator piston (2) in said cylinder (1).

20. An actuator, comprising:

a cylinder (1);

an actuator piston (2) displacably arranged in the cylinder (1);

a gas circuit channel (3) mouthing into said cylinder (1);

a first valve body (4) arranged in said gas circuit channel (3), that in a first position the first valve body (4) keeps the gas circuit channel (3) closed, and in a second position the first valve body (4) keeps the gas circuit channel (3) open;

a second valve body (5) arranged in the gas circuit channel (3) to open and close the gas circuit channel (3), the second valve body (5) being fixedly connected to the actuator piston (2);

an electrically controlled three-way valve (18) arranged to alternately open for pressure fluid communication i) between an activation channel (19) and a high pressure source (HP), and ii) between the activation channel (19) and a low pressure source (LP), wherein chosen pressure fluid pressure in the activation channel (19) flow is arranged to act against and admit displacement of the first valve body (4);

a hydraulic lock (11) comprising a non-return valve (13) located within a further channel (12) extending from said gas circuit channel (3), wherein the hydraulic lock (11) acts against the second valve body (5) via the further channel (12); and a hydraulic valve located in the further channel (12) and connected to the first valve body (4), wherein the hydraulic valve is open when the first valve body (4) is in the first position keeping the gas circuit circuit (3) closed, and the hydraulic valve is closed when the first valve body (4) is in the second position keeping the gas circuit channel (3) open.

* * * * *